US011444366B2

(12) United States Patent
Moon et al.

(10) Patent No.: US 11,444,366 B2
(45) Date of Patent: Sep. 13, 2022

(54) CONICAL RESONATOR FORMED BY WINDING A TAPE-SHAPED BAND IN AN OVERLAPPING MANNER INTO A TRUNCATED CONE SHAPE

(71) Applicant: ELECTRONICS AND TELECOMMUNICATIONS RESEARCH INSTITUTE, Daejeon (KR)

(72) Inventors: Jung Ick Moon, Daejeon (KR); Je Hoon Yun, Daejeon (KR); In Kui Cho, Daejeon (KR); Ho Jin Lee, Daejeon (KR); Sang-Won Kim, Daejeon (KR); Seong-Min Kim, Daejeon (KR); Jang Yeol Kim, Daejeon (KR); Jaewoo Lee, Daejeon (KR); Hyunjoon Lee, Busan (KR); Dong Won Jang, Daejeon (KR)

(73) Assignee: ELECTRONICSAND TELECOMMUNICATIONS RESEARCH INSTITUTE, Daejeon (KR)

( * ) Notice: Subject to any disclaimer, the term of this patent is extended or adjusted under 35 U.S.C. 154(b) by 21 days.

(21) Appl. No.: 17/105,755

(22) Filed: Nov. 27, 2020

(65) Prior Publication Data

US 2021/0167476 A1 Jun. 3, 2021

(30) Foreign Application Priority Data

Nov. 28, 2019 (KR) ..... 10-2019-0155141
Nov. 27, 2020 (KR) ..... 10-2020-0162527

(51) Int. Cl.
*H01P 7/00* (2006.01)
*H01P 1/208* (2006.01)
*H01P 11/00* (2006.01)

(52) U.S. Cl.
CPC ..... *H01P 7/005* (2013.01); *H01P 1/2084* (2013.01); *H01P 11/008* (2013.01)

(58) Field of Classification Search
CPC .... H01P 7/005; H01P 7/00; H01P 1/20; H01P 1/20381; H01P 11/008
USPC ..... 333/219
See application file for complete search history.

(56) References Cited

U.S. PATENT DOCUMENTS 5,883,565 A * 3/1999 Furino, Jr. ..... H01P 1/20 338/216
8,299,874 B2 * 10/2012 Hyde et al. ..... H01Q 15/0086 333/202
9,508,488 B2 11/2016 Vendik et al.
9,954,580 B2 4/2018 Krishna et al.
2011/0199273 A1 8/2011 Kim et al.
(Continued)

FOREIGN PATENT DOCUMENTS

JP 2018-514786 A 6/2018
KR 10-1798991 A1 12/2017

*Primary Examiner* — Benny T Lee
(74) *Attorney, Agent, or Firm* — LRK Patent Law Firm

(57) ABSTRACT

Disclosed is a resonator for expanding a transfer distance. A conical resonator includes a metal layer configured to operate according to a resonant frequency, and a dielectric layer coupled to the top or bottom of the metal layer to space the metal layer apart from another metal layer without overlap, wherein the metal layer and the dielectric layer have a Swiss-roll structure, and include an input face to which power is supplied on the bottom and an open face on the top.

11 Claims, 7 Drawing Sheets

(56) References Cited

U.S. PATENT DOCUMENTS

2012/0306280 A1* 12/2012 Krishna et al. ..... H01P 11/008
307/104
2015/0207233 A1 7/2015 Kim et al.

* cited by examiner

CONICAL RESONATOR FORMED BY WINDING A TAPE-SHAPED BAND IN AN OVERLAPPING MANNER INTO A TRUNCATED CONE SHAPE

CROSS-REFERENCE TO RELATED APPLICATION(S)

This application claims the benefit of Korean Patent Application No. 10-2019-0155141, filed on Nov. 28, 2019, and Korean Patent Application No. 10-2020-0162527, filed on Nov. 27, 2020, in the Korean Intellectual Property Office, the disclosures of which are incorporated herein by reference.

BACKGROUND

1. Field of the Invention

One or more example embodiments relate to a resonator, and more particularly, to a conical resonator and a dipole resonator that are manufactured in structures for expanding a transfer distance.

2. Description of Related Art

A conical resonator has a resonant frequency that changes according to the diameter, the height, and the number of turns in the conical resonator.

However, the conventional conical resonators have been manufactured by winding metal around a conical dielectric to maintain the conical shape. The shapes of the conventional conical resonators are determined according to the shape of the dielectric, and the shape of the dielectric cannot be changed. Thus, it is impossible to change the resonant frequency through a change of the shape such as the height of the cone after manufactured.

Further, the conventional conical resonators are manufactured by winding metal with predetermined intervals to prevent an overlap between previously wound metal and currently wound metal for short prevention. Thus, there were restrictions on miniaturization due to the spontaneous occurrence of the intervals between the metals.

Accordingly, there is a need for a conical resonator that has a variable resonant frequency and may be manufactured in a small size.

SUMMARY OF THE INVENTION

An aspect provides a conical resonator that may easily adjust a resonant frequency through a structure in which metal layers are wound to be shaped like a cone and to partly overlap each other along the axis of the cone.

Another aspect also provides a conical resonator that has an adjustable height and thus, may easily adjust a resonant frequency and be miniaturized.

Another aspect also provides a conical resonator that may be miniaturized by adding a spiral resonator to an open face or input face thereof.

Another aspect also provides a dipole resonator that is miniaturized by coupling conical resonators whose input faces have different diameters.

According to an aspect, there is provided a conical resonator including a metal layer configured to operate according to a resonant frequency, and a dielectric layer coupled to the top or bottom of the metal layer to space the metal layer apart from another metal layer without overlap, wherein the metal layer and the dielectric layer may have a Swiss-roll structure, and include an input face to which power is supplied on the bottom and an open face on the top.

The dielectric layer may have the same area as or a larger area than the metal layer to which the dielectric layer is coupled.

The area of overlap between the dielectric layer and the other metal layer may increase when pressure is applied upward and downward, such that the height of the conical resonator may decrease.

The area of overlap between the dielectric layer and the other metal layer may decrease when force to pull upward or downward is applied, such that the height of the conical resonator may increase.

The conical resonator may further include a spiral resonator to be coupled to the input face to lower the resonant frequency of the metal layer.

The conical resonator may further include a spiral resonator to be coupled to the open face to lower the resonant frequency of the metal layer.

The conical resonator may further include a spiral resonator to be coupled to the inside of the conical resonator to lower the resonant frequency of the metal layer.

The conical resonator may further include a first low-loss dielectric plate coupled to the open face, a second low-loss dielectric plate coupled to the input face, and a low-loss dielectric pillar configured to connect the center of the first low-loss dielectric plate and the center of the second low-loss dielectric plate.

According to another aspect, there is provided a dipole resonator including a first conical resonator including a metal layer and a dielectric layer that are coupled in a structure in which an input face to which power is supplied is formed on the bottom side and an open face is formed on the top side, a second conical resonator including a metal layer and a dielectric layer that are coupled in a structure in which an input face to which power is supplied is formed on the top side and an open face is formed on the bottom side, and a power supply connected to the input face of the first conical resonator and the input face of the second conical resonator to supply power to the input face of the first conical resonator and the input face of the second conical resonator.

The second conical resonator may be coupled to the first conical resonator by inserting the input face of the second conical resonator, which has a smaller diameter than the input face of the first conical resonator, into the first conical resonator.

The first conical resonator may be coupled to the second conical resonator by inserting the input face of the first conical resonator, which has a smaller diameter than the input face of the second conical resonator, into the second conical resonator.

The second conical resonator and the first conical resonator may be formed in a symmetric structure about the power supply and have the same impedance.

Additional aspects of example embodiments will be set forth in part in the description which follows and, in part, will be apparent from the description, or may be learned by practice of the disclosure.

According to example embodiments, it is possible to provide a conical resonator that may easily adjust a resonant frequency through a structure in which metal layers are wound to be shaped like a cone and to partly overlap each other along the axis of the cone.

According to example embodiments, it is possible to provide a conical resonator that has an adjustable height and thus, may easily adjust a resonant frequency and be miniaturized.

According to example embodiments, it is possible to provide a conical resonator that may be miniaturized by adding a spiral resonator to an open face or input face thereof.

According to example embodiments, it is possible to provide a dipole resonator that is miniaturized by coupling conical resonators whose input faces have different diameters.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION OF THE INVENTION

Figure 1:
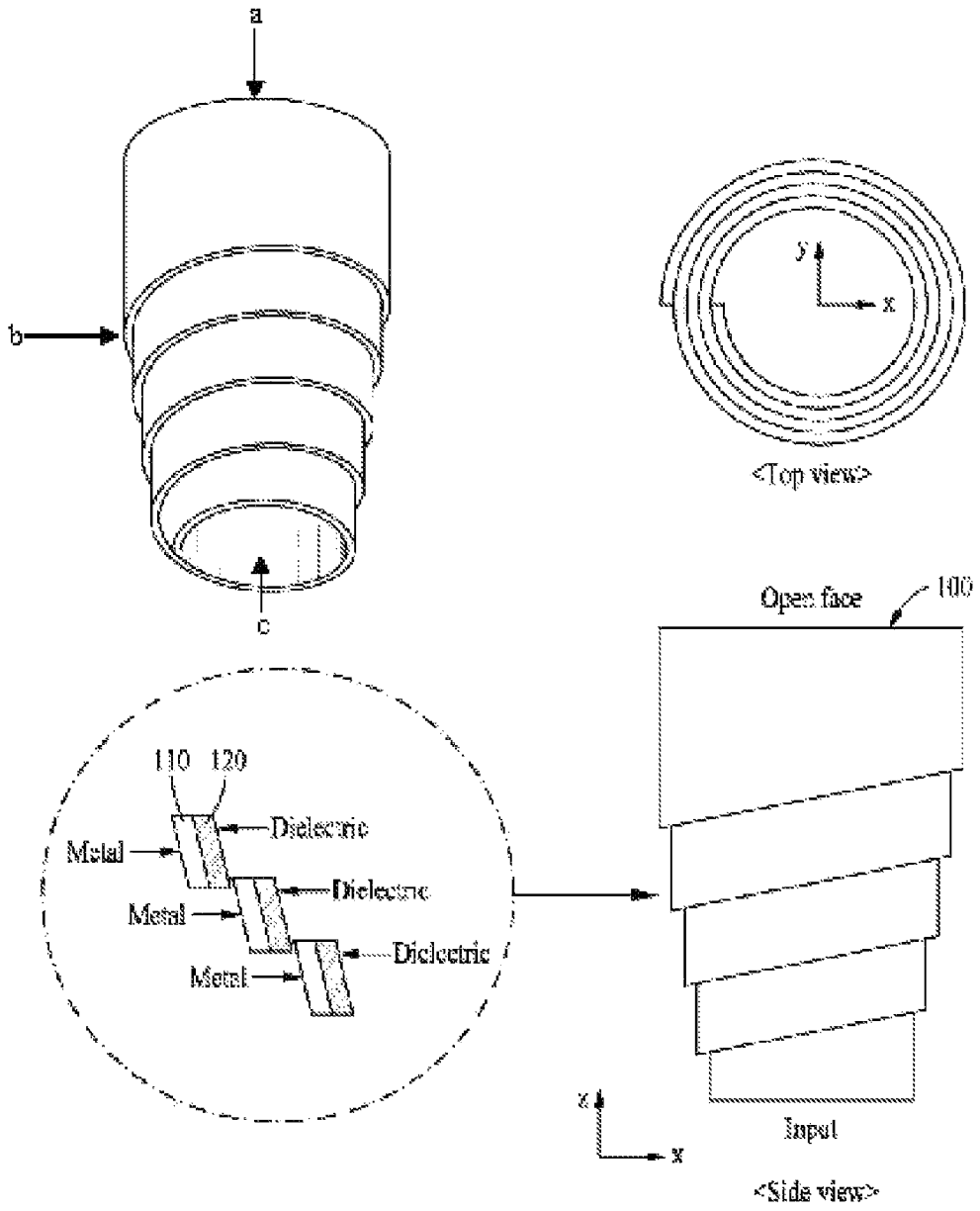
FIG. 1 illustrates a conical resonator according to an example embodiment.

Hereinafter, example embodiments will be described in detail with reference to the accompanying drawings. However, various alterations and modifications may be made to the example embodiments. Here, the example embodiments are not construed as limited to the disclosure. The example embodiments should be understood to include all changes, equivalents, and replacements within the idea and the technical scope of the disclosure.

The terminology used herein is for the purpose of describing particular example embodiments only and is not to be limiting of the example embodiments. The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

When describing the example embodiments with reference to the accompanying drawings, like reference numerals refer to like constituent elements and a repeated description related thereto will be omitted. In the description of example embodiments, detailed description of well-known related structures or functions will be omitted when it is deemed that such description will cause ambiguous interpretation of the present disclosure. In the drawings, the top view, the side view, and the bottom view indicate views seen from the arrow 'a', the arrow 'b', and the arrow 'c', respectively, in a conical resonator shown on the left top of FIG. 1.

Hereinafter, example embodiments will be described in detail with reference to the accompanying drawings.

FIG. 1 illustrates a conical resonator according to an example embodiment.

A conical resonator 100 according to an example embodiment may be a resonator formed by winding a tape-shaped band in which a metal layer 110 and a dielectric layer 120 are combined, as shown on the left top of FIG. 1, and thus have a structure as shown in the top view of FIG. 1 and include an input face to which power is supplied on the bottom side of the structure and an open face on the top side of the structure. In FIG. 1, coordinate designations (x, y) indicate directional orientations of the top view of the conical resonator 100 when seen from the arrow 'a', and coordinate designation z indicates a direction vertical to the coordinate designations (x, y).

In this example, the metal layer 110 may operate according to a resonant frequency, and the dielectric layer 120 may be coupled to the top or bottom of the metal layer 110 to space the metal layer 110 apart in a shape wound in a partly overlapping manner. In detail, as shown on the left bottom of FIG. 1, the dielectric layer 120 coupled to the bottom of the metal layer 110 may prevent the metal layer 110 from contacting a metal layer located one step below the metal layer 110.

That is, the dielectric layer 120 may be coupled with the metal layer 110 to prevent the metal layer 110 from contacting other metal layers, thereby allowing the metal layers to overlap each other along a Z direction.

In addition, since the dielectric layer 120 may adjust the portions overlapping the other metal layers according to the design or the manufacturer's intention, there is no possibility of a short circuit between the metal layers. Therefore, the conical resonator 100 may have a structure in which the metal layers overlap each other in the Z direction, facilitating resonant frequency adjustment.

Further, although FIG. 1 shows the conical resonator 100 that is manufactured in the shape of a circular cone, the conical resonator 100 may also be manufactured in the shape of a square pyramid or a polygonal pyramid.

The diameter of the input face of the conical resonator 100 may be smaller than that of the open face as shown in FIG. 1. Alternately, in some example embodiments, the diameter of the input face of the conical resonator 100 may be the same as that of the open face.

In addition, the input face and the open face of the conical resonator 100 may be concentric as shown in FIG. 1. Alternatively, the input face and the open face may not be concentric according to the installation or the designer's intention. A conical resonator in which the input face and the open face are not concentric may be a curved conical resonator.

Figure 2:
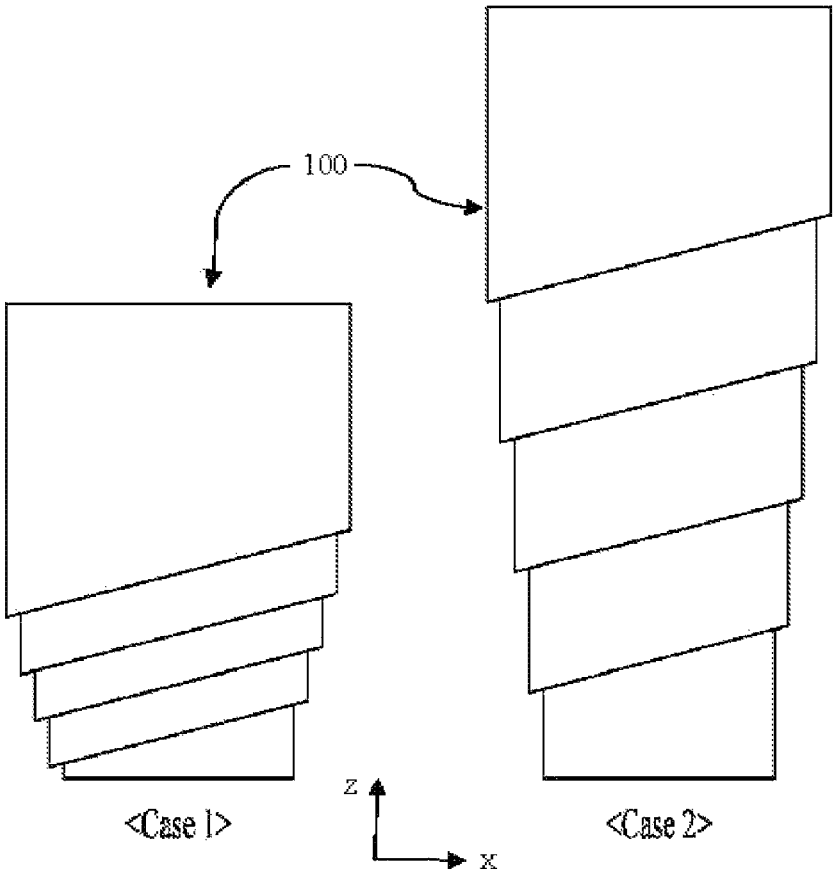
FIG. 2 illustrates an operation of changing the height of a conical resonator according to an example embodiment.

FIG. 2 illustrates an operation of changing the height of a conical resonator according to an example embodiment. In this example embodiment, the conical resonator 100 is formed by winding a tape-shaped band in which the metal layer 110 and the dielectric layer 120 are combined, as shown on the left top of FIG. 1. In FIG. 2, coordinate designations (x, z) indicate directional orientations of the side view of the conical resonator 100 when seen from the arrow 'b' in the conical resonator shown on the left top of FIG. 1.

When the dielectric layer 120 producing little friction is used, the conical resonator 100 may easily extend and contract in the Z direction as shown in FIG. 2. Thus, it is possible to miniaturize the conical resonator 100.

In this example, when pressure is applied from the top or bottom of the conical resonator 100 toward the center thereof, the area of overlap between the dielectric layer 120 coupled to the metal layer 110 and the other metal layers may increase, such that the height of the conical resonator 100 may decrease as shown in Case 1.

Conversely, when force to pull the conical resonator 100 upward or downward is applied, the area of overlap between the dielectric layer 120 coupled to the metal layer 110 and the other metal layers may decrease, such that the height of the conical resonator 100 may increase as shown in Case 2.

Figure 3:
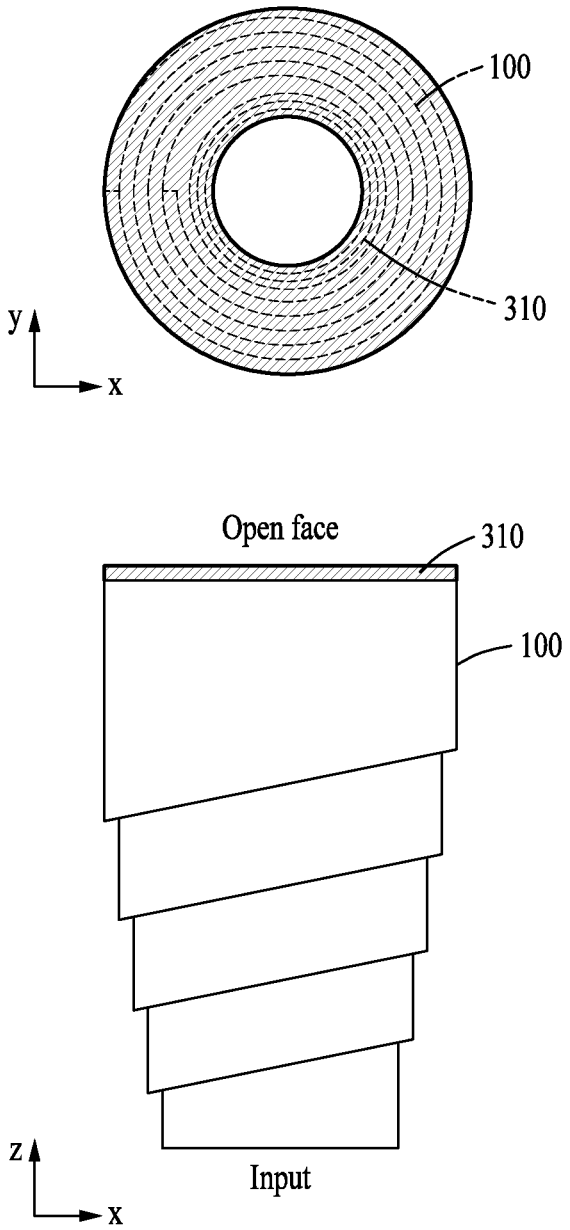
FIG. 3 illustrates an example of a spiral resonator added to an open face of a conical resonator according to an example embodiment.

FIG. 3 illustrates an example of a spiral resonator added to an open face of a conical resonator according to an example embodiment. In this example embodiment, the conical resonator 100 is formed by winding a tape-shaped band in which the metal layer 110 and the dielectric layer 120 are combined, as shown on the left top of FIG. 1. In FIG. 3, coordinate designations (x, y) indicate directional orientations of the top view of a conical resonator 100 and a spiral resonator 310 when seen from the arrow 'a' shown on the left top of FIG. 1, and coordinate designation z indicates a direction vertical to the coordinate designations (x, y).

By additionally coupling a spiral resonator 310 to the open face of the conical resonator 100 as shown in FIG. 3, the resonant frequency of the metal layer 110 may be lowered.

In this example, the spiral resonator 310 may also be defined as an extension of the conical resonator 100 and may be formed in a wire shape. The spiral resonator 310 may not be on the same plane as the open face of the conical resonator 100. The spiral resonator 310 may be manufactured in the same structure as the conical resonator 100 so as to adjust the height thereof.

Figure 4:
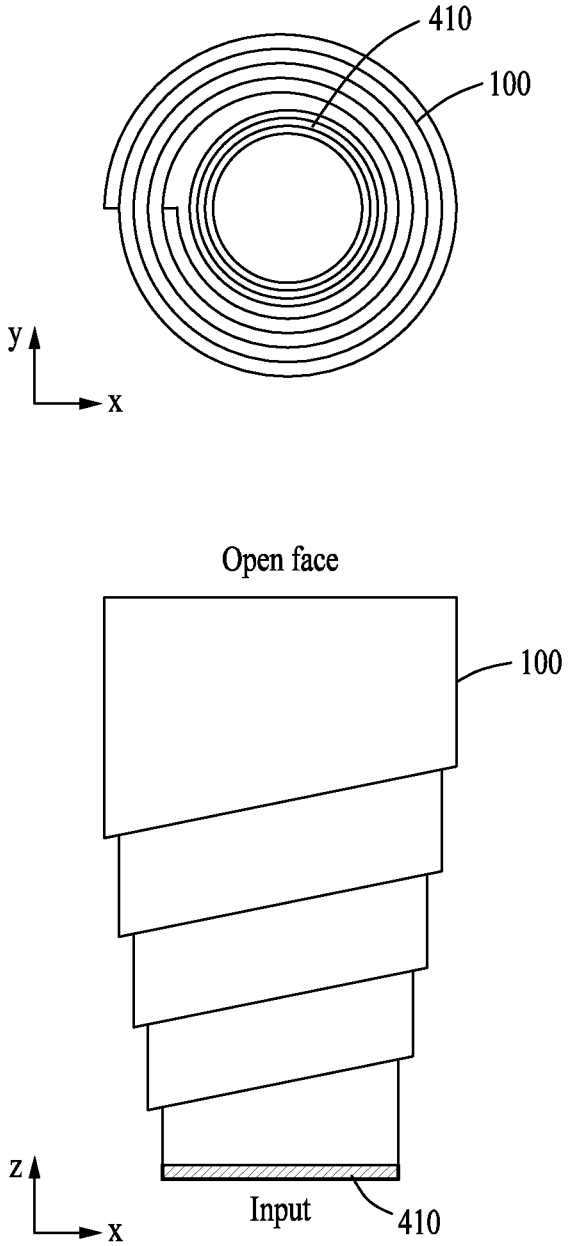
FIG. 4 illustrates an example of a spiral resonator added to an input face of a conical resonator according to an example embodiment.

FIG. 4 illustrates an example of a spiral resonator added to an input face of a conical resonator according to an example embodiment. In FIG. 4, coordinate designations (x, y) indicate directional orientations of the top view of a conical resonator 100 and a spiral resonator 410 when seen from the arrow 'a' shown on the left top of FIG. 1, and coordinate designation z indicates a direction vertical to the coordinate designations (x, y).

By additionally coupling a spiral resonator 410 to the input face of the conical resonator 100 as shown in FIG. 4, the resonant frequency of the metal layer 110 may be lowered.

Alternatively, both the spiral resonator 310 in FIG. 3 and the spiral resonator 410 in FIG. 4 may be coupled to the conical resonator 100. In addition, the spiral resonator may be inserted and coupled to the inside of the conical resonator 100 at a predetermined height.

Figure 5:
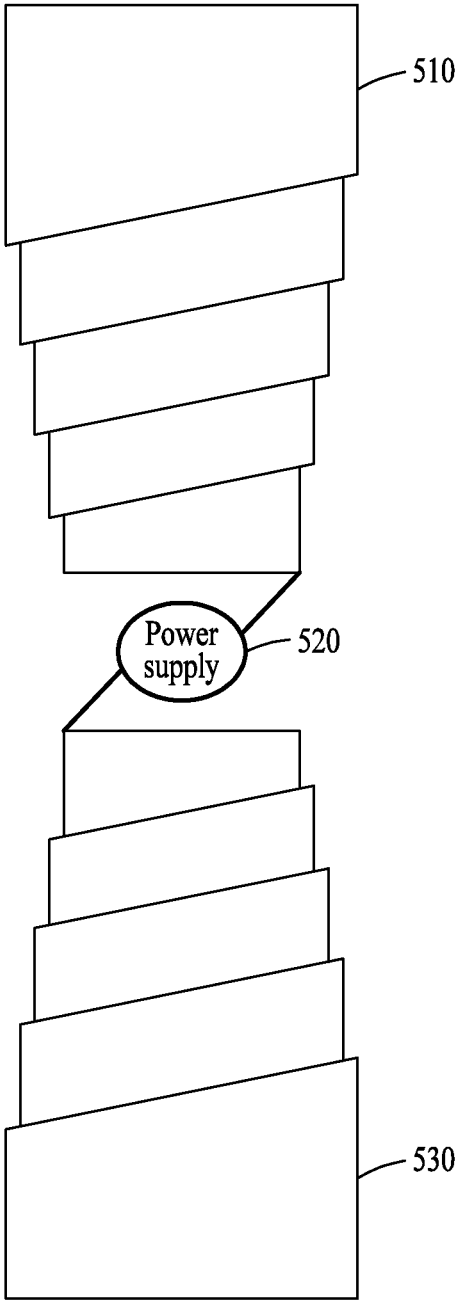
FIG. 5 illustrates an example of a dipole resonator including conical resonators according to an example embodiment.

FIG. 5 illustrates an example of a dipole resonator including conical resonators according to an example embodiment.

Referring to FIG. 5, a dipole resonator may include a first conical resonator 510, a power supply 520, and a second conical resonator 530.

The first conical resonator 510 may be a conical resonator including a metal layer and a dielectric layer that are coupled in a structure in which an input face to which power is supplied is formed on the bottom side and an open face is formed on the top side. For example, the first conical resonator 510 may be manufactured in the same structure as the conical resonator 100 of FIG. 1.

The power supply 520 may be connected to the input face of the first conical resonator 510 and an input face 530 of the second conical resonator. The power supply 520 may supply power to the input face of the first conical resonator 510 and the input face of the second conical resonator 530.

The second conical resonator 530 may be a conical resonator including a metal layer and a dielectric layer that are coupled in a structure in which the input face to which power is supplied is formed on the top side and an open face is formed on the bottom side. For example, the second conical resonator 530 may be manufactured in a structure in which the top and the bottom of the conical resonator of FIG. 1 are reversed in position.

Figure 6:
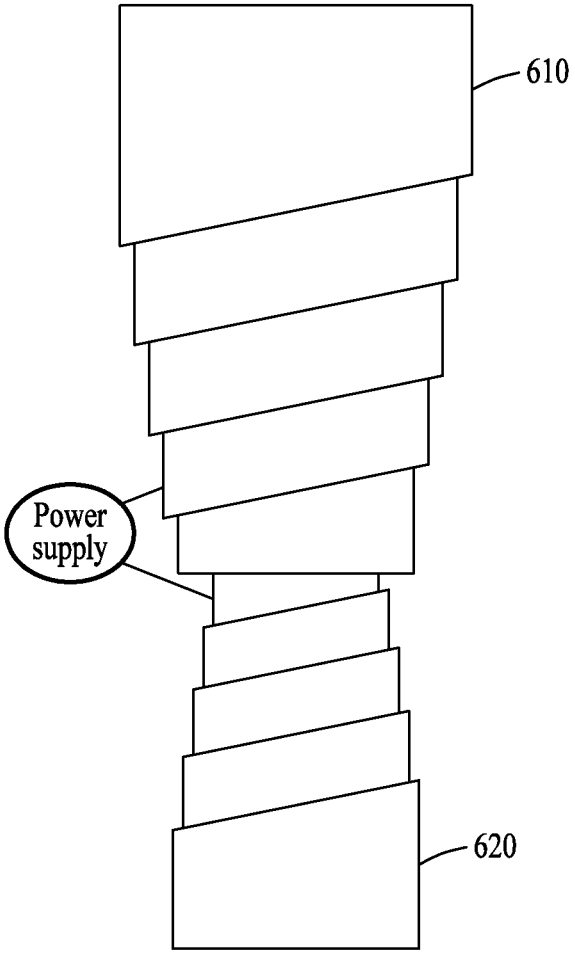
FIG. 6 illustrates another example of a dipole resonator including conical resonators according to an example embodiment.

FIG. 6 illustrates another example of a dipole resonator including conical resonators according to an example embodiment.

Referring to FIG. 6, a dipole resonator may include a first conical resonator 610, a power supply, and a second conical resonator 620.

The second conical resonator 620 may be a resonator in which the diameter of an input face is to be adjusted to be smaller than the diameter of an input face of the first resonator 610. In this example, the dipole resonator of FIG. 6 may be manufactured by inserting and coupling the input face of the second conical resonator 620, which has a smaller diameter than the input face of the first conical resonator 610, to the input face of the first conical resonator 610, whereby the resonant frequency may be lowered. The dipole resonator may lower the resonant frequency according to the structure shown in FIG. 6 and thus, may be miniaturized.

Further, the second conical resonator 620 and the first conical resonator 610 may be formed in a symmetric structure about the power supply, thereby increasing the transmission efficiency of the dipole resonator as shown by a top view, by a bottom view and by a side view.

In addition, the second conical resonator 620 and the first conical resonator 610 may have the same impedance.

Alternatively, although not shown in FIG. 6, the dipole resonator may be manufactured by inserting and coupling the first conical resonator 610 to the second conical resonator 620. In this example, the first conical resonator 610 may be coupled to the second conical resonator 620 by inserting the input face of the first conical resonator 610, which has a smaller diameter than the input face of the second conical resonator 620, into the input face of the second conical resonator 620.

Figure 7:
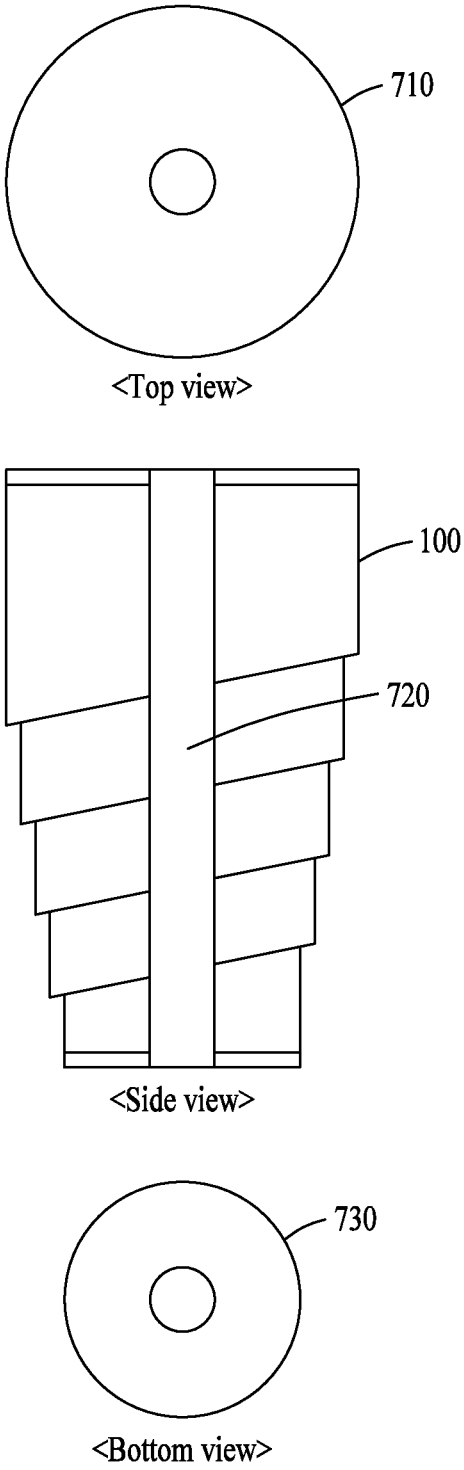
FIG. 7 illustrates an example of a dielectric plate and a dielectric pillar added to a conical resonator according to an example embodiment.

FIG. 7 illustrates an example of a dielectric plate and a dielectric pillar added to a conical resonator according to an example embodiment.

The conical resonator 100 may further include a first low-loss dielectric plate 710 coupled to the open face, a second low-loss dielectric plate 730 coupled to the input face, and a low-loss dielectric pillar 720 connecting the center of the first low-loss dielectric plate 710 and the center of the second low-loss dielectric plate 730.

In this example, the conical resonator 100 may easily maintain the shape thereof by matching the center of the open face and the center of the input face by means of the low-loss dielectric plates.

In addition, the conical resonator 100 including the low-loss dielectric pillar 720 may vary in height along the low-loss dielectric pillar 720 in the process of adjusting the height, thereby preventing misalignment during the process of adjusting the height.

According to example embodiments, it is possible to provide a conical resonator that may easily adjust a resonant frequency through a structure in which metal layers are wound to be shaped like a cone and to partly overlap each other along the axis of the cone. According to example embodiments, it is possible to provide a conical resonator that has an adjustable height and thus, may easily adjust a resonant frequency and be miniaturized.

According to example embodiments, it is possible to provide a conical resonator that may be miniaturized by adding a spiral resonator to an open face or input face thereof. According to example embodiments, it is possible to provide a dipole resonator that is miniaturized by coupling conical resonators whose input faces have different diameters.

Although the specification includes the details of a plurality of specific implementations, it should not be understood that the details of the specific implementations are restricted with respect to the scope of any invention or claimable matter. On the contrary, the details of the specific implementations should be understood as the description about features that may be specific to the specific example embodiment of a specific invention. Specific features that are described in this specification in the context of respective embodiments may be implemented by being combined in a single embodiment. On the other hand, the various features described in the context of the single embodiment may also be implemented in a plurality of embodiments, individually or in any suitable sub-combination. Furthermore, the features operate in a specific combination and may be described as being claimed. However, one or more features from the claimed combination may be excluded from the combination in some cases. The claimed combination may be changed to sub-combinations or the modifications of sub-combinations.

Likewise, the operations in the drawings are described in a specific order. However, it should not be understood that such operations need to be performed in the specific order or sequential order illustrated to obtain desirable results or that all illustrated operations need to be performed. In specific cases, multitasking and parallel processing may be advantageous. Moreover, the separation of the various device components of the above-described embodiments should not be understood as requiring such the separation in all embodiments, and it should be understood that the described program components and devices may generally be integrated together into a single software product or may be packaged into multiple software products.

In the meantime, embodiments of the present invention disclosed in the specification and drawings are simply the presented specific example to help understand an embodiment of the present invention and not intended to limit the scopes of embodiments of the present invention. It is obvious to those skilled in the art that other modifications based on the technical idea of the present invention may be performed in addition to the embodiments disclosed herein.

EXPLANATION OF REFERENCE NUMERALS

100: Conical resonator
110: Metal layer
120: Dielectric layer

What is claimed is:

1. A conical resonator comprising:

a metal layer configured to operate according to a resonant frequency; and a dielectric layer coupled to a top or bottom of the metal layer, wherein the conical resonator is formed in a shape of truncated cone by winding in a partly overlapping manner a tape-shaped band in which the metal layer and the dielectric layer are combined, the metal layer being spaced apart by the dielectric layer in a shape wound in the partly overlapping manner, and wherein the conical resonator has an input face on a bottom thereof to which power is supplied and an open face on a top thereof.

2. The conical resonator of claim 1, wherein the dielectric layer has a same area as the metal layer to which the dielectric layer is coupled.

3. The conical resonator of claim 1, wherein overlapped portions between the dielectric layer and the metal layer in the shape wound in the partly overlapping manner increase when pressure is applied upward and downward on the conical resonator, such that a height of the conical resonator decreases.

4. The conical resonator of claim 1, wherein overlapped portions between the dielectric layer and the metal layer in the shape wound in the partly overlapping manner decrease when force to pull upward or downward is applied on the conical resonator, such that a height of the conical resonator increases.

5. The conical resonator of claim 1, further comprising:

a spiral resonator to be coupled to the input face to lower the resonant frequency of the metal layer.

6. The conical resonator of claim 1, further comprising:

a spiral resonator to be coupled to the open face to lower the resonant frequency of the metal layer.

7. The conical resonator of claim 1, further comprising:

a first low-loss dielectric plate coupled to the open face;

a second low-loss dielectric plate coupled to the input face; and a low-loss dielectric pillar configured to connect a center of the first low-loss dielectric plate and a center of the second low-loss dielectric plate.

8. A dipole resonator comprising:

a first conical resonator comprising a first metal layer and a first dielectric layer and formed in a shape of truncated cone by winding in a partly overlapping manner a tape-shaped band in which the first metal layer and the first dielectric layer are combined, the first conical resonator having an input face on a bottom thereof to which power is supplied, and an open face on a top thereof;

a second conical resonator comprising a second metal layer and a second dielectric layer and formed in a shape of truncated cone by winding in a partly overlapping manner a tape-shaped band in which the second metal layer and the second dielectric layer are combined, the second conical resonator having an input face on a top thereof to which power is supplied and an open face on a bottom thereof; and a power supply connected to the input face of the first conical resonator and the input face of the second conical resonator to supply power to the input face of the first conical resonator and the input face of the second conical resonator.

9. The dipole resonator of claim 8, wherein the second conical resonator and the first conical resonator are formed in a symmetric structure about the power supply and have a same impedance.

10. The dipole resonator of claim 8, wherein the second conical resonator is coupled to the first conical resonator by inserting the input face of the second conical resonator into the first conical resonator, the input face of the second conical resonator having a smaller diameter than the input face of the first conical resonator.

11. The dipole resonator of claim 8, wherein the first conical resonator is coupled to the second conical resonator by inserting the input face of the first conical resonator into the second conical resonator, the input face of the first conical resonator having a smaller diameter than the input face of the second conical resonator.

* * * * *